US007909069B2

(12) United States Patent
Hughes

(10) Patent No.: US 7,909,069 B2
(45) Date of Patent: Mar. 22, 2011

(54) SYSTEM AND METHOD FOR AUTOMATICALLY ADJUSTING AN ORVR COMPATIBLE STAGE II VAPOR RECOVERY SYSTEM TO MAINTAIN A DESIRED AIR-TO-LIQUID (A/L) RATIO

(75) Inventor: Kevin Hughes, West Hartford, CT (US)

(73) Assignee: Veeder-Root Company, Simsbury, CT (US)

( * ) Notice: Subject to any disclaimer, the term of this patent is extended or adjusted under 35 U.S.C. 154(b) by 1295 days.

(21) Appl. No.: 11/418,726

(22) Filed: May 4, 2006

(65) Prior Publication Data

US 2007/0267088 A1 Nov. 22, 2007

(51) Int. Cl.
*B65B 31/00* (2006.01)

(52) U.S. Cl. ..... 141/7; 141/59

(58) Field of Classification Search ..... 141/7, 45, 141/52, 53, 59, 94, 301, 302
See application file for complete search history.

(56) References Cited

U.S. PATENT DOCUMENTS

| | | | |
|---|---|---|---|
| 3,016,928 | A | 1/1962 | Brandt |
| 3,641,817 | A | 2/1972 | Dory |
| 3,735,634 | A | 5/1973 | Clinton et al. |
| 3,748,903 | A | 7/1973 | Irie et al. |
| 4,147,096 | A | 4/1979 | Caswell |
| 4,166,485 | A | 9/1979 | Wokas |
| 4,215,565 | A | 8/1980 | Zanker |
| 4,312,238 | A | 1/1982 | Rey |
| 4,508,127 | A | 4/1985 | Thurston |
| 4,543,819 | A | 10/1985 | Chin et al. |
| 4,566,504 | A | 1/1986 | Furrow et al. |
| 4,570,686 | A | 2/1986 | Devine |
| 4,611,729 | A | 9/1986 | Gerstenmaier et al. |
| 4,653,334 | A | 3/1987 | Capone |
| 4,687,033 | A | 8/1987 | Furrow et al. |

(Continued)

FOREIGN PATENT DOCUMENTS

| | | |
|---|---|---|
| GB | 2316060 | 2/1998 |
| WO | WO00/50850 | 8/2000 |

OTHER PUBLICATIONS

"Carb Need to Modify Plan for Improving Vapor Recovery Program, Viewpoint: More Time, Better Data Needed," Wolf H. Koch, PhD, Petroleum Equipment and Technology Magazine, Aug. 1999.

(Continued)

*Primary Examiner* — Timothy L Maust
*Assistant Examiner* — Jason K Niesz
(74) *Attorney, Agent, or Firm* — Nelson Mullins Riley & Scarborough LLP

(57) ABSTRACT

A system and method for automatically adjusting an ORVR-compatible Stage II vapor recovery system to maintain the air-to-liquid (A/L) ratio within desired tolerances or limits to meet regulatory and/or other requirements. An air flow sensor (AFS) or vapor flow meter measures the amount of recovered vapor for a dispensing point to calculate the recovery efficiency of the system in the form of the A/L ratio. Volume or flow rate measurements can be used. ORVR fueling transactions are either minimized or excluded from the A/L ratio, so that the A/L ratio is not artificially lowered due to a blocked or altered recovery. The A/L ratio is then compared to a desired or nominal A/L ratio. Adjustments to the recovery system are made within prescribed safety tolerances if the A/L ratio differs from the desired ratio.

16 Claims, 6 Drawing Sheets

U.S. PATENT DOCUMENTS 4,739,648 A 4/1988 Horner
4,749,009 A 6/1988 Faeth
4,827,987 A 5/1989 Faeth
4,842,027 A 6/1989 Faeth
4,871,450 A 10/1989 Goodrich et al.
4,938,251 A 7/1990 Furrow et al.
4,967,809 A 11/1990 Faeth
4,983,251 A 1/1991 Haisma et al.
4,986,445 A 1/1991 Young et al.
5,013,434 A 5/1991 Furrow
5,027,499 A 7/1991 Prohaska
5,032,008 A 7/1991 Yamamoto et al.
5,038,838 A 8/1991 Bergamini et al.
5,038,922 A 8/1991 Collins et al.
5,040,077 A 8/1991 Hamano
5,040,576 A 8/1991 Faeth
5,040,577 A 8/1991 Pope
5,116,759 A 5/1992 Klainer et al.
5,129,433 A 7/1992 Faeth
5,143,258 A 9/1992 Mittermaier
5,151,111 A 9/1992 Tees et al.
5,156,199 A 10/1992 Hartsell, Jr. et al.
5,165,379 A 11/1992 Thompson
5,195,564 A 3/1993 Spalding
5,203,384 A 4/1993 Hansen
5,240,045 A 8/1993 Faeth
5,244,022 A 9/1993 Gimby
5,267,470 A 12/1993 Cook
5,269,353 A 12/1993 Nanaji et al.
5,280,814 A 1/1994 Stroh
5,295,391 A 3/1994 Mastandrea et al.
5,323,817 A 6/1994 Spalding
5,332,008 A 7/1994 Todd et al.
5,332,011 A 7/1994 Spalding
5,333,654 A 8/1994 Faeth
5,333,655 A 8/1994 Bergamini et al.
5,355,915 A 10/1994 Payne
5,365,985 A 11/1994 Todd et al.
5,386,812 A 2/1995 Curran et al.
5,417,256 A 5/1995 Hartsell, Jr. et al.
5,450,883 A 9/1995 Payne et al.
5,452,621 A 9/1995 Aylesworth et al.
5,460,054 A 10/1995 Tran
5,464,466 A 11/1995 Nanaji et al.
5,500,369 A 3/1996 Kiplinger
5,507,325 A 4/1996 Finlayson
RE35,238 E 5/1996 Pope
5,542,458 A 8/1996 Payne et al.
5,563,339 A 10/1996 Compton et al.
5,563,341 A 10/1996 Fenner et al.
5,568,828 A 10/1996 Harris
5,571,310 A 11/1996 Nanaji
5,590,697 A 1/1997 Benjey et al.
5,592,979 A 1/1997 Payne et al.
5,625,156 A 4/1997 Serrels et al.
5,626,649 A 5/1997 Nanaji
5,650,943 A 7/1997 Powell et al.
5,663,492 A 9/1997 Alapati et al.
5,671,785 A 9/1997 Andersson
5,720,325 A 2/1998 Grantham
5,728,275 A 3/1998 Twigg
5,728,948 A 3/1998 Bignell et al.
5,752,411 A 5/1998 Harpster
5,755,854 A 5/1998 Nanaji
5,767,175 A 6/1998 Kamekura et al.
5,779,097 A 7/1998 Olson et al.
5,780,245 A 7/1998 Maroteaux
5,782,275 A 7/1998 Hartsell, Jr. et al.
5,794,667 A 8/1998 Payne et al.
5,796,009 A 8/1998 Delsing
5,803,136 A 9/1998 Hartsell, Jr.
5,832,967 A 11/1998 Andersson
5,843,212 A 12/1998 Nanaji
5,850,857 A * 12/1998 Simpson ..... 141/59
5,857,500 A 1/1999 Payne et al.
5,860,457 A 1/1999 Andersson
5,868,175 A 2/1999 Duff et al.
5,878,790 A 3/1999 Janssen
5,889,202 A 3/1999 Alapati et al.
5,898,108 A 4/1999 Mieczkowski et al.
5,911,248 A 6/1999 Keller
5,913,343 A 6/1999 Andersson
5,942,980 A 8/1999 Hoben et al.
5,944,067 A 8/1999 Andersson
5,956,259 A 9/1999 Hartsell, Jr. et al.
5,972,980 A 10/1999 Cornicelli et al.
5,985,002 A 11/1999 Grantham
5,988,232 A 11/1999 Koch et al.
5,992,395 A 11/1999 Hartsell, Jr. et al.
6,016,928 A 1/2000 Cothran et al.
6,026,866 A 2/2000 Nanaji
6,026,868 A 2/2000 Johnson, Jr.
6,037,184 A 3/2000 Matilainen et al.
6,038,922 A 3/2000 Mauze et al.
6,047,745 A 4/2000 Fournier
6,065,507 A 5/2000 Nanaji
6,070,453 A 6/2000 Myers
6,082,415 A 7/2000 Rowland et al.
6,102,085 A 8/2000 Nanaji
6,103,532 A 8/2000 Koch et al.
6,123,118 A 9/2000 Nanaji
6,131,621 A 10/2000 Garrard
6,151,955 A 11/2000 Ostrowski et al.
6,167,747 B1 1/2001 Koch et al.
6,167,923 B1 1/2001 Hartsell, Jr.
6,169,938 B1 1/2001 Hartsell, Jr.
6,170,539 B1 * 1/2001 Pope et al. ..... 141/59
6,223,789 B1 5/2001 Koch
6,244,310 B1 6/2001 Rowland et al.
6,247,508 B1 6/2001 Negley, III et al.
6,302,165 B1 10/2001 Nanaji et al.
6,305,440 B1 10/2001 McCall et al.
6,325,112 B1 12/2001 Nanaji
6,336,479 B1 1/2002 Nanaji
6,338,369 B1 1/2002 Shermer et al.
6,347,649 B1 2/2002 Pope et al.
6,357,493 B1 3/2002 Shermer et al.
D457,084 S 5/2002 Pope
6,386,246 B2 5/2002 Pope et al.
6,418,981 B1 7/2002 Nitecki et al.
6,460,579 B2 * 10/2002 Nanaji ..... 141/59
6,499,516 B2 12/2002 Pope et al.
6,622,757 B2 9/2003 Hart et al.
6,802,344 B2 10/2004 Hart et al.
6,802,345 B1 10/2004 Hart et al.
6,810,922 B1 11/2004 Grantham
6,880,585 B2 4/2005 Hart et al.
6,901,786 B2 6/2005 Hart
6,923,221 B2 8/2005 Riffle
6,941,978 B2 9/2005 Riffle
6,968,868 B2 11/2005 Hart et al.
6,975,964 B2 12/2005 Reichler et al.
7,032,630 B1 * 4/2006 Grantham ..... 141/59
2005/0080589 A1 4/2005 Tiberi

OTHER PUBLICATIONS

"Draft Performance Standards for In-Station Diagnostics (to be incorporated into CP-201)," California Air Resources Board, Revised Aug. 23, 1999.

"Effectiveness of Refueling Vapor Recovery Still Up in The Air, Key Questions Remain on ORVR and Stage II," Joe Totten, Petroleum Equipment and Technology Magazine, Apr. 1999.

"Final Statement of Reasons for Rulemaking, Including Summary of Comments and Agency Response—Public Hearing to Consider The Adoption, Amendment and Repeal of Regulations Regarding Certification Procedures and Test Procedures for Gasoline Vapor Recovery Systems," California Environmental Protection Agency Air Resources Board, Public Hearing Dates: Mar. 23, 2000, Agenda Item No. 00-3-2.

"Gasoline Vapor Recovery Systems Test Methods Existing Procedures," California Air Resources Board, updated Dec. 24, 2001.

"Hearing Notice and Staff Report, Enhanced Vapor Recovery, Initial Statement of Reasons for Proposed Amendments ot the Vapor Recovery Certification and Test Procedures for Gasonline Loading and Motor Vehicle Gasoline Refueling at Service Stations," California Air Resources Board, Feb. 4, 2000.
"Membranes, Molecules and the Science of Permeation, Can Escaping Vapors be Recaptured with New Technology?" Tedmund P. Tiberi, Petroleum Equipment & Technology, Apr. 1999.
"Vapor Recovery Around the World," Tedmund P. Tiberi, Petroleum Equipment & Technology, Sep. 2000.
"Vapor Recovery Certification and Test Procedure Regulations for Enhanced Vapor Recovery Documents," California Air Resources Board, updated Jan. 29, 2004.
"Vapor Recovery Certification Procedure CP-201 Certification Procedures for Vapor Recovery Systems at Gasoline Dispensing Facilities," California Environmental Protection Agency Air Resources Board.
"Vapor Recovery Test Procedure TP-201.3 Determination of 2 Inch WC Static Pressure Performance of Vapor Recovery Systems at Dispensing Facilities," California Environmental Protection Agency Air Resources Board.
"Vapor Recovery Test Procedure TP-201.5 Air to Liquid Volume Ratio," California Environmental Protection Agency Air Resources Board.
"What Does Field Testing Show for Assist Vapor Recovery Systems? An Evaluation of CARB's Performance Tests," Wolf H. Koch, PhD, & W. Dwain Simpson, PhD, Petroleum Equipment & Technology, Oct. 1999.
"Notice of Public Hearing to Consider Amendments to the Vapor Recovery Certification and Test Procedure Regulations for Enhanced Vapor Recovery," Title 17, California Environmental Protection Agency Air Resources Board.
"Retooling the Vapor Recovery System—Part 2: Will New Rules Evade Old Concerns?" Wolf H. Koch, PhD, Petroleum Equipment & Technology Magazine, Jul. 2000.
"Retooling the Vapor Recovery System—Part 3: Reactions by Equipment Makers: Hirt Systems Design Changes," Robert D. Bradt, PhD, PE, Petroleum Equipment & Technology, Aug. 2000.
"Retooling the Vapor Recovery System—Part 3: Reactions by Equipment Makers: VST's Membrane Technology Development," Glenn K. Walker, Petroleum Equipment & Technology, Aug. 2000.
"Retooling the Vapor Recovery System—Part 3: Reactions by Equipment Makers: Some Fugitive Emissions Remain at Large," Tedmund P. Tiberi, Petroleum Equipment & Technology, Aug. 2000.
"Unbalanced Treatment of Assist Vapor Recovery Systems," Wolf H. Koch, Phd, Petroleum Equipment & Technology Magazine, Nov. 1999.

* cited by examiner

SYSTEM AND METHOD FOR AUTOMATICALLY ADJUSTING AN ORVR COMPATIBLE STAGE II VAPOR RECOVERY SYSTEM TO MAINTAIN A DESIRED AIR-TO-LIQUID (A/L) RATIO

RELATED APPLICATIONS

The present application is related to U.S. patent application Ser. No. 11/210,715, filed on Aug. 24, 2005; which is a continuation patent application of U.S. patent application Ser. No. 10/935,024, now U.S. Pat. No. 6,964,283, filed on Sep. 7, 2004; which is a continuation patent application of U.S. patent application Ser. No. 10/180,047, now U.S. Pat. No. 6,802,344, filed on Jun. 27, 2002; which is a divisional patent application of U.S. Pat. No. 6,622,757, filed on Nov. 30, 2000, entitled "Fueling System Vapor Recovery And Containment Performance Monitor And Method Of Operation Thereof;" all of which are entitled to the benefit of the earlier filing date and priority of U.S. Provisional Patent Application Ser. No. 60/168,029, filed on Nov. 30, 1999, entitled "Fueling System Vapor Recovery Performance Monitor," U.S. Provisional Patent Application Ser. No. 60/202,054, filed on May 5, 2000, entitled "Fueling System Vapor Recovery Performance Monitor," and U.S. Provisional Patent Application Ser. No. 60/202,659, filed on May 8, 2000, entitled "Method of Determining Failure of Fuel Vapor Recovery System."

All of the aforementioned patents, regular patent applications, and provisional patent applications are hereby incorporated by reference herein in their entireties.

FIELD OF THE INVENTION

The present invention relates to automatically adjusting an ORVR-compatible Stage II vapor recovery system to maintain the A/L ratio within desired tolerances or limits to meet regulatory and/or other requirements.

BACKGROUND OF THE INVENTION

Gasoline dispensing facilities (i.e. gasoline stations) often suffer from a loss of fuel to the atmosphere due to inadequate vapor collection during fuel dispensing activities, excess liquid fuel evaporation in the containment tank system, and inadequate reclamation of the vapors during tanker truck deliveries. Lost vapor is an air pollution problem which is monitored and regulated by both the federal government and state governments. Attempts to minimize losses to the atmosphere have been effected by various vapor recovery methods. Such methods include: "Stage-I vapor recovery" where vapors are returned from the underground fuel storage tank to the delivery truck; "Stage-II vapor recovery" where vapors are returned from the refueled vehicle tank to the underground storage tank; vapor processing where the fuel/air vapor mix from the underground storage tank is received and the vapor is liquefied and returned as liquid fuel to the underground storage tank; burning excess vapor off and venting the less polluting combustion products to the atmosphere; and other fuel/air mix separation methods.

A "balance" Stage-II Vapor Recovery System (VRS) may make use of a dispensing nozzle bellows seal to the vehicle tank filler pipe opening. This seal provides an enclosed space between the vehicle tank and the VRS. During fuel dispensing, the liquid fuel entering the vehicle tank creates a positive pressure which pushes out the ullage space vapors through the bellows sealed area into the nozzle vapor return port, through the dispensing nozzle and hose paths, and on into the VRS.

It has been found that even with these measures, substantial amounts of hydrocarbon vapors are lost to the atmosphere, often due to poor equipment reliability and inadequate maintenance. This is especially true with Stage-II systems. One way to reduce this problem is to provide a vapor recovery system monitoring data acquisition and analysis system to provide notification when the system is not working as required. Such monitoring systems may be especially applicable to Stage-II systems.

When working properly, Stage-II vapor recovery results in equal exchanges of air or vapor (A) and liquid (L) between the main fuel storage tank and the consumer's gas tank. Ideally, Stage-II vapor recovery produces an A/L ratio very close to 1.0. In other words, returned vapor replaces an equal amount of liquid in the main fuel storage tank during refueling transactions. When the A/L ratio is close to 1.0, refueling vapors are collected, the ingress of fresh air into the storage tank is minimized, and the accumulation of an excess of positive or negative pressure in the main fuel storage tank is prevented. This minimizes losses at the dispensing nozzle and evaporation and leakage of excess vapors from the storage tank. Measurement of the A/L ratio thus provides an indication of proper Stage-II vapor collection operation. A low A/L ratio means that vapor is not moving properly through the dispensing nozzle, hose, or other part of the system back to the storage tank, possibly due to an obstruction or defective component.

Recently, the California Air Resources Board (CARB) has been producing new requirements for Enhanced Vapor Recovery (EVR) equipment. These include stringent vapor recovery system monitoring and In-Station Diagnostics (ISD) requirements to continuously determine whether or not the systems are working properly. CARB has proposed that when the A/L ratio drops below a prescribed limit for a single or some sequence of fueling transactions, an alarm be issued and the underground storage tank pump be disabled to allow repair to prevent further significant vapor losses. Many systems employ air flow sensors (AFS), also known as "vapor flow meters" to monitor the amount of recovered vapor to determine if the vapor recovery system is working correctly.

Even with use of AFS, CARB only requires monitoring and alarm generation if the A/L ratio is outside the prescribed limits. Automatic correction of the vapor recovery system is not required. However, if AFSs are used, the vapor recovery system can determine the difference between the desired A/L ratio versus actual performance. In this manner, in addition to monitoring, the vapor recovery system can automatically adjust itself in a closed loop, feedback manner to correct itself. A service call to adjust the vapor recovery system manually can be avoided thereby resulting in lower costs and convenience. A shut down of fuel dispensers may also be avoided. However, this vapor recovery system performance may be detrimentally effected by the introduction of vehicles with Onboard Refueling Vapor Recovery (ORVR) devices that recover refueling vapors onboard the vehicle. CARB also requires that Stage II vapor recovery systems be compatible for both ORVR and non-ORVR fueling transactions.

Vapors produced as a result of dispensing fuel into an ORVR equipped vehicle are collected onboard, and accordingly, are not available to flow through a vapor return passage to an AFS for measurement. Some vapor recovery systems are designed to block the vapor return path when an ORVR-equipped vehicle is being refueled. One such device is disclosed in U.S. Pat. No. 6,810,922, incorporated herein by reference in its entirety. This prevents the ingestion of air into the fuel storage tank, which in turn causes decreased pressure levels within the tank and a lesser possibility for fugitive emissions through the tank vent. With such systems, refueling an ORVR-equipped vehicle results in a positive liquid fuel flow reading, but no return vapor flow reading (i.e. an A/L ratio calculated using the AFS will be equal to 0 or close thereto). Because ORVR fueling transactions cause the AFS measurement to suggest a blockage requiring an A/L adjustment, an ORVR-compatible closed loop, self-adjusting vapor recovery system that employs the AFS will not operate properly.

Thus, there exists a need to provide a self-adjusting ORVR-compatible vapor recovery system that does not improperly adjust the vapor recovery rate during or due to ORVR fueling transactions. The present invention provides a solution to this problem.

SUMMARY OF THE INVENTION

The present invention is a system and method for automatically adjusting an ORVR-compatible Stage II vapor recovery system to maintain the air-to-liquid (A/L) ratio within desired tolerances or limits to meet regulatory and/or other requirements. An air flow sensor (AFS) or vapor flow meter measures the amount of recovered vapor for a dispensing point to calculate the recovery efficiency of the system in the form of the A/L ratio. Volume or flow rate measurements can be used. ORVR fueling transactions are either minimized or excluded from the A/L ratio calculation, so that the A/L ratio is not artificially lowered due to a blocked or altered recovery present during an ORVR fueling transaction. The A/L ratio is then compared to a desired or nominal A/L ratio. Adjustments are made to dispensing points that share a common recovery system vapor pump if the A/L ratio differs from the desired ratio. The adjustments are made to attempt to keep all dispensing points sharing a common vapor pump in desired A/L operating ranges, and if not possible, an alarm or error can be generated and/or reported.

The system can distinguish between ORVR and non-ORVR fueling events in different manners. If the ORVR valve 228 contains a sensing device that is coupled to the control system 270, the system can distinguish between ORVR and non-ORVR-equipped vehicles on a transaction-by-transaction basis. The system may also distinguish between ORVR and non-ORVR-equipped vehicles using a series of statistical algorithms to distinguish between ORVR and non-ORVR equipped vehicles using a set of collected A/L ratio data from all monitored dispensers at a station.

A calculation of the vapor recovery system adjustment for each grade of fuel at a dispensing point is calculated based on the non-ORVR fueling transactions. Multiple grades of fuel in the exemplary embodiment are coupled to a common vapor recovery system; thus, an adjustment to the recovery system affects the A/L ratio of each grade of fuel. The average of all the desired vapor pump adjustments for all grades of fuel of the dispensing point is calculated. The maximum positive and negative adjustment that can be made to a dispensing point and the recovery remain within prescribed safety ranges for all grades of fuel is determined. The final calculated adjustment is based the minimum of the maximum vapor pump adjustments calculated for all grades. This is so that the overall adjustment is made to be within maximum adjustment ranges of all grades of fuel for the dispensing point. The final adjustment is used to calculate the corrected vapor collection value, which in turn allows determination of a corrected A/L ratio for each grade of fuel. The system then adjusts the vapor pump 222 if variable speed, or proportional valves if constant speed, so that the corrected A/L ratio is achieved.

If any of the A/L ratios for the dispensing point are outside of prescribed safety range even with the adjustment being made, an alarm and/or report can be generated. The dispensing point could be shut down, or the error reported to the remote system, so that corrective measures can be taken to investigate.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the invention, and together with the description serve to explain the principles of the invention.

The invention will be described in conjunction with the following drawings in which like reference numerals designate like elements and wherein.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention is a system and method for automatically adjusting an ORVR-compatible Stage II vapor recovery system to maintain the air-to-liquid (A/L) ratio within desired tolerances or limits to meet regulatory and/or other requirements. An air flow sensor (AFS) or vapor flow meter measures the amount of recovered vapor for a dispensing point to calculate the recovery efficiency of the system in the form of the A/L ratio. Volume or flow rate measurements can be used. ORVR fueling transactions are either minimized or excluded from the A/L ratio calculation, so that the A/L ratio is not artificially lowered due to a blocked or altered recovery present during an ORVR fueling transaction. The A/L ratio is then compared to a desired or nominal A/L ratio. Adjustments are made to dispensing points that share a common recovery system vapor pump if the A/L ratio differs from the desired ratio. The adjustments are made to attempt to keep all dispensing points sharing a common vapor pump in desired A/L operating ranges, and if not possible, an alarm or error can be generated and/or reported.

Vapor Recovery System

Figure 2:
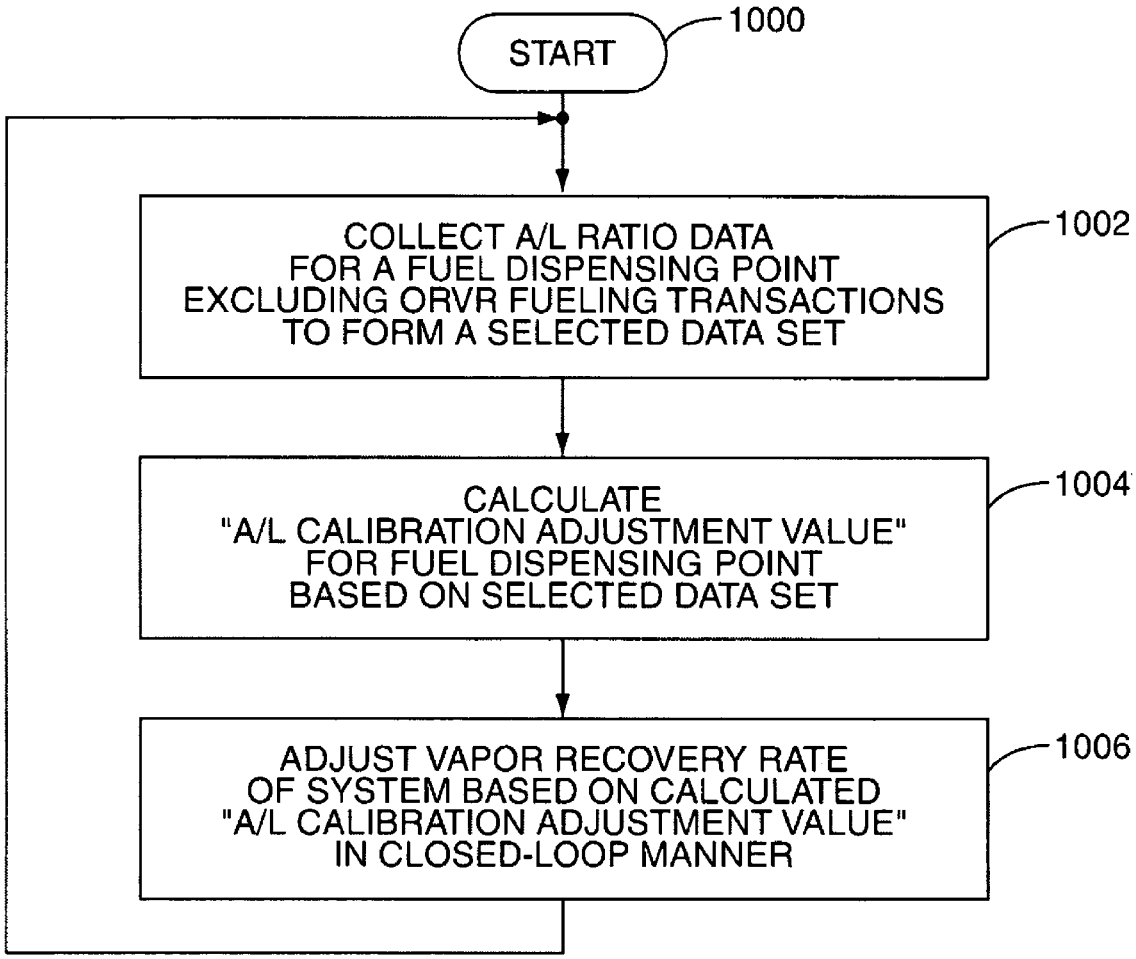
FIG. 2 is a flowchart illustration of the basic operation of the vapor recovery performance monitor and adjustment system.
Figure 3A:
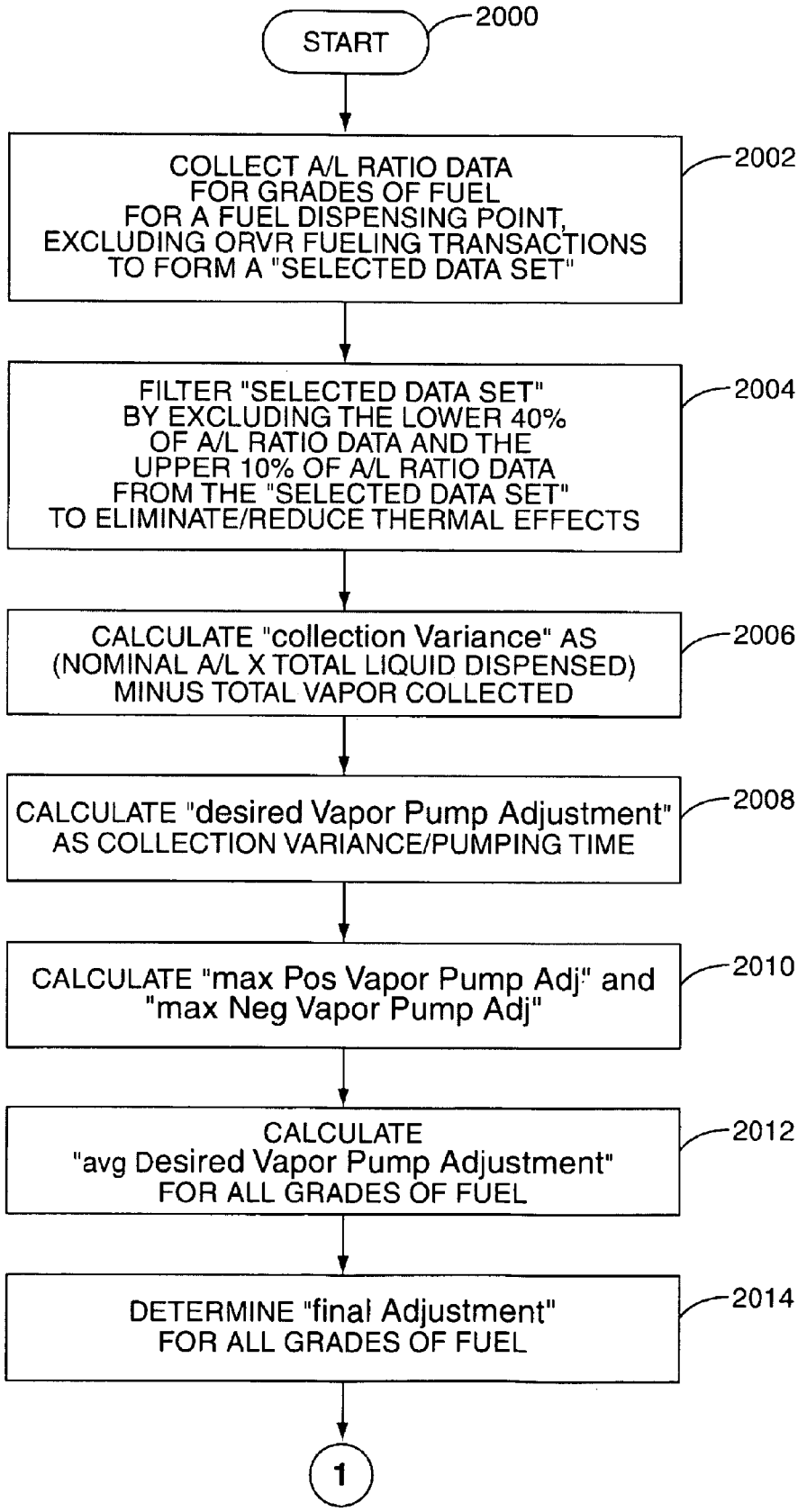
FIGS. 3A-3B are flowchart illustrations of operation of the vapor recovery performance monitor and adjustment system in accordance with one embodiment of the present invention.
Figure 3B:
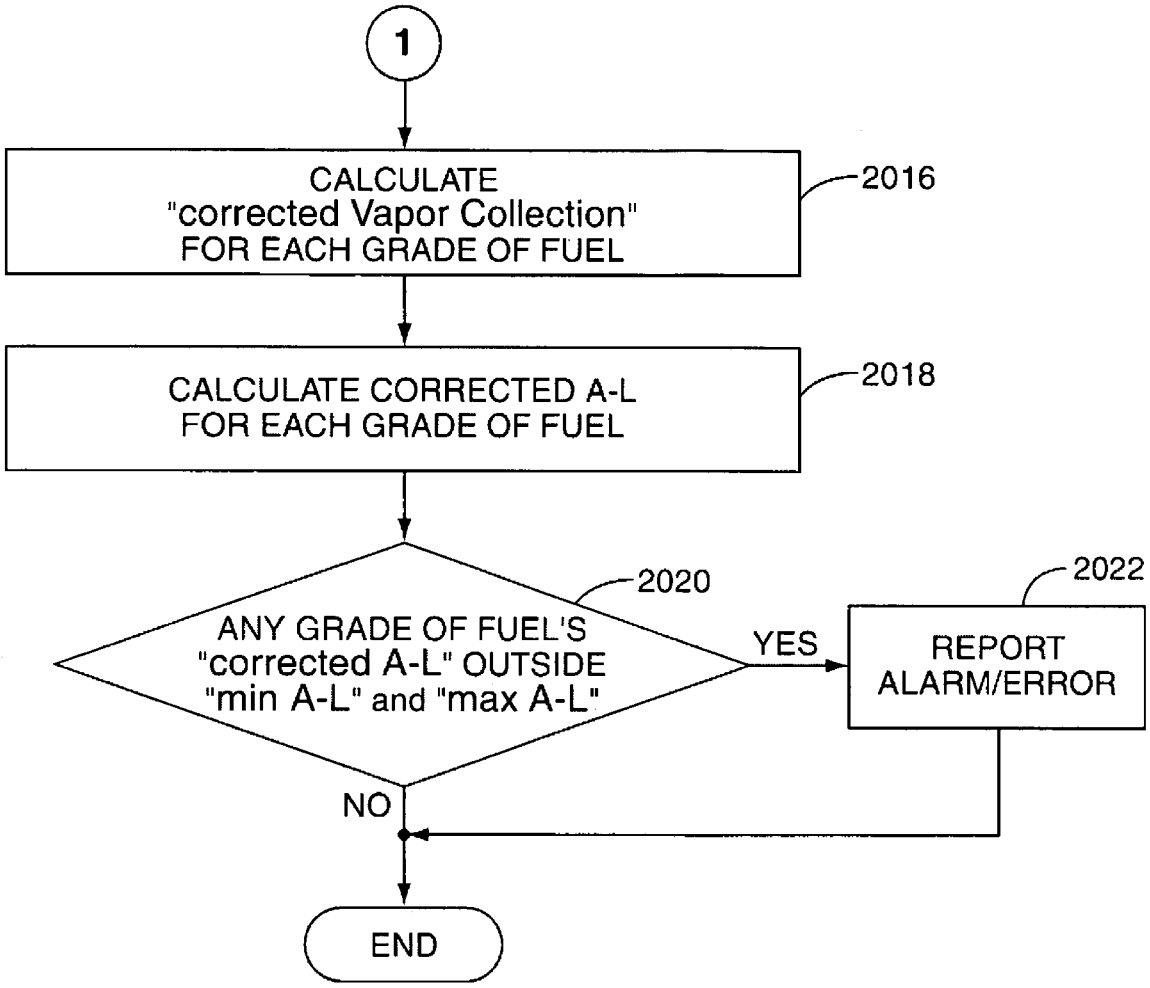
Figure 4:
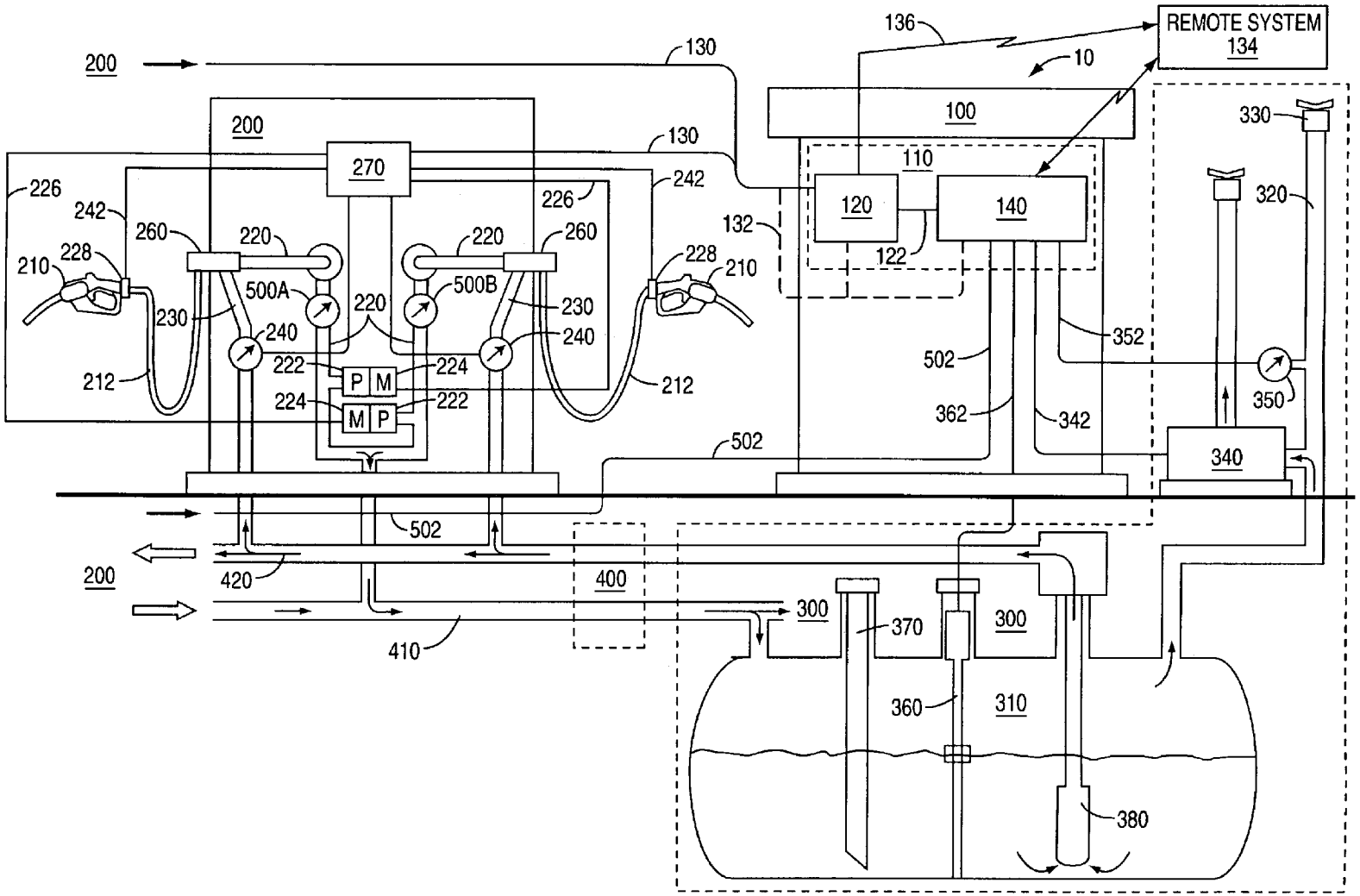
FIG. 4 is a schematic view of a fueling system vapor recovery performance monitor and adjustment system in accordance with another embodiment of the present invention.
Figure 5:
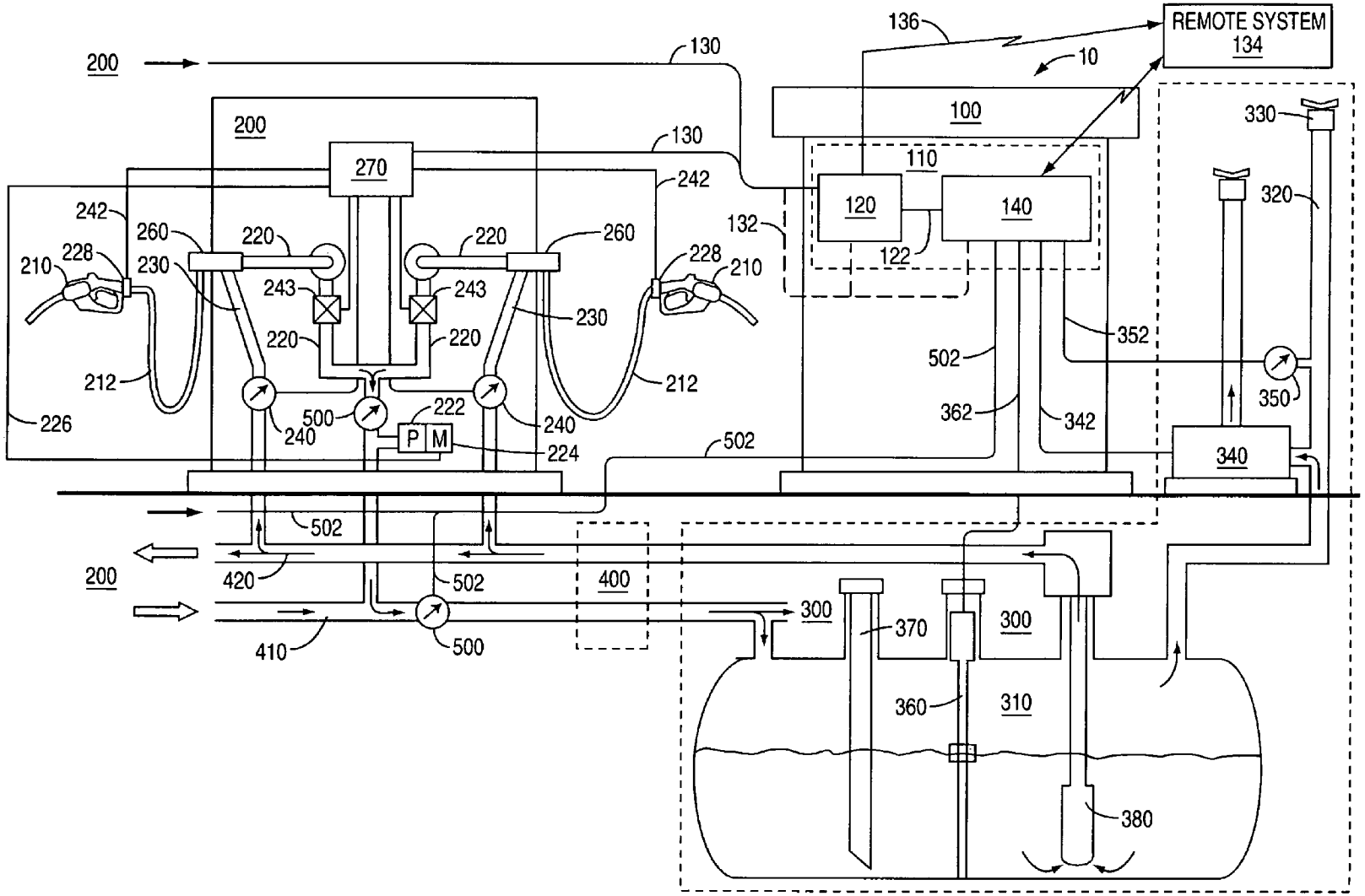
FIG. 5 is a schematic view of a fueling system vapor recovery performance monitor and adjustment system in accordance with another embodiment of the present invention.

A first embodiment of the invention is described in connection with FIG. 1, which shows a vapor recovery and containment monitoring and adjustment system for use in a liquid fuel dispensing facility 10. The dispensing facility 10 may include a station house 100, one or more fuel dispenser units 200, a main fuel storage system 300, means for connecting the dispenser units 200 to the main fuel storage system 400, and one or more vapor (or air) flow sensors (AFS's) 500. FIGS. 2-3 illustrate flow charts of the vapor recovery adjustment system in conjunction with exemplary embodiments of FIG. 1. FIGS. 4 and 5 illustrate alternative vapor recovery system and fuel dispenser 200 configuration embodiments that may also be employed by the present invention.

Figure 1:
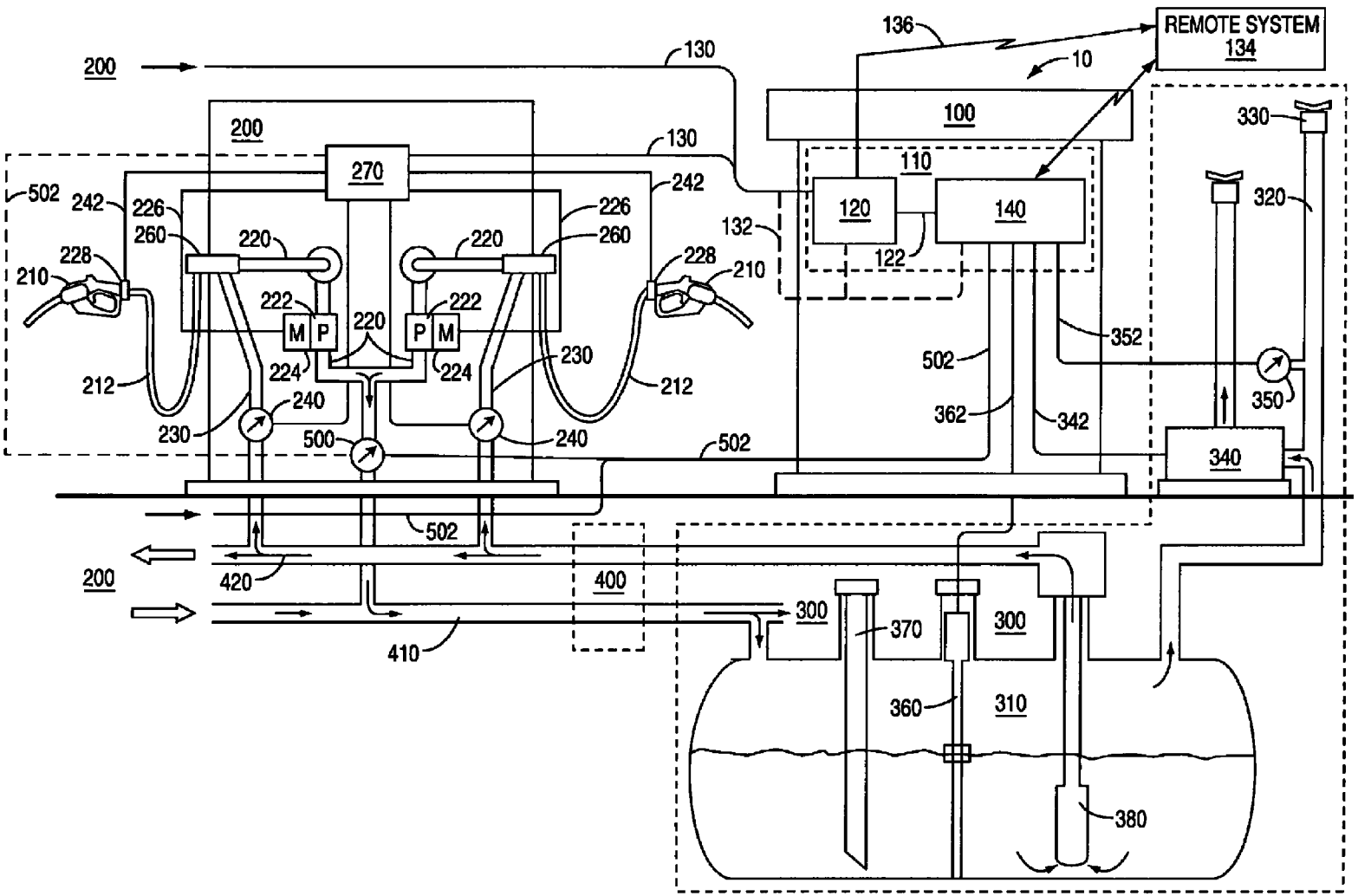
FIG. 1 is a schematic view of a fueling system vapor recovery performance monitor and adjustment system in accordance with one embodiment of the present invention.

As illustrated in FIG. 1, the station house 100 may include a central electronic control and diagnostic arrangement 110 that includes a dispenser controller 120 (also known as a site controller or point-of-sale system), dispenser current loop interface wiring 130 connecting the dispenser controller 120 with the dispenser unit(s) 200, and a combined data acquisition system/in-station diagnostic monitor 140. The dispenser controller 120 controls the dispensers 200 and processes transaction information received from the dispensers 200 over the current loop 130. The dispenser controller 120 may be electrically connected to the monitor 140 by a first wiring bus 122. The interface wiring 130 may be electrically connected to the monitor 140 by a second wiring bus 132. The monitor 140 may include standard computer storage and central processing capabilities, keyboard input device(s), and audio and visual output interfaces among other conventional features.

The dispenser controller 120 may be the Gilbarco G-Site® or Passport® point-of-sale system. The monitor 140 may be the Veeder-Root Company TLS-350® tank monitor. Both the dispenser controller 120 and the monitor 140 may be further communicatively coupled to an off-site or remote system 134 for communicating information and receiving instructions remotely. Both systems may communicate with the remote system 134 over telephone lines 136 or other network lines 136, including the Internet.

The fuel dispenser units 200 may be provided in the form of conventional "gas pumps." Each fuel dispenser unit 200 may include one or more fuel dispensing points typically defined by nozzles 210. The fuel dispenser units 200 may include one coaxial vapor/liquid splitter 260, one vapor return passage 220, and one fuel supply passage 230 per nozzle 210. The vapor return passages 220 may be joined together before connecting with a common vapor return pipe 410. The fuel dispenser units 200 may also include one liquid fuel dispensing meter 240 per nozzle 210. The liquid fuel dispensing meters 240 may provide dispensed liquid fuel quantity information to the dispenser controller 120 via a liquid fuel dispensing meter interface 270, or control system, and interface wiring 130.

The main fuel storage system 300 may include one or more main fuel storage tanks 310. It is appreciated that the storage tanks 310 may typically be provided underground, however, underground placement of the tank is not required for application of the invention. It is also appreciated that the storage tank 310 may represent a grouping of multiple storage tanks tied together into a storage tank network. Each storage tank 310, or a grouping of storage tanks, may be connected to the atmosphere by a vent pipe 320. The vent pipe 320 may terminate in a pressure relief valve 330. A vapor processor 340 may be connected to the vent pipe 320 intermediate of the storage tank 310 and the pressure relief valve 330. A pressure sensor 350 may also be operatively connected to the vent pipe 320. Alternately, it may be connected directly to the storage tank 310 or the vapor return pipe 410 below or near to the dispenser 200, since the pressure is normally substantially the same at all these points in the vapor containment system. The storage tank 310 may also include an Automatic Tank Gauging System (ATGS) 360 used to provide information regarding the fuel level in the storage tank. The vapor processor 340, the pressure sensor 350, and the automatic tank gauging system 360 may be electrically connected to the monitor 140 by third, fourth, and fifth wiring busses 342, 352, and 362, respectively. The storage tank 310 may also include a fill pipe and fill tube 370 to provide a means to fill the tank with fuel and a submersible pump 380 to supply the dispensers 200 with fuel from the storage tank 310.

The means for connecting the dispenser units and the main fuel storage system 300 may include one or more vapor return pipelines 410 and one or more fuel supply pipelines 420. The vapor return pipelines 410 and the fuel supply pipelines 420 are connected to the vapor return passages 220 and fuel supply passages 230, respectively, associated with multiple fuel dispensing points 210. As such, a "vapor return pipeline" designates any return pipeline that carries the return vapor of two or more vapor return passages 220. In the illustrated embodiment in FIG. 1, a variable speed vapor pump 222 controlled by a motor 224 is coupled to the vapor return passages 220 to assist in the recovery of vapor. An example of this system is found in U.S. Pat. No. 5,040,577, incorporated herein by reference in its entirety. The control system 270 controls the motor 224, via a control line 226, to control the speed of the vapor pump 222, thereby controlling the recovery rate in proportion to the fuel dispensed in an equal volume exchange. Most systems attempt to achieve a A/L ratio of 1.0. The control system 270 is calibrated with calibration or vapor pump control values that control the vapor pump 220 in correlation to the fuel dispensed or fuel dispensing rate for a variable speed vapor pump, or adjusts proportional flow control valves for a constant speed vapor pump. The present invention may be used with either system.

An AFS's 500 is deployed in a common branch of the vapor return passages 220 to measure various groupings of dispensing point 210 vapor flows, down to a minimum of only two dispensing point vapor flows. The latter example may be realized by installing one AFS 500 in each dispenser housing 200, which typically contains two dispensing point's 210 (one dispensing point per dispenser side) or up to six dispensing points (hoses 212) in MultiProduct Dispensers (MPD's) (3 per side). The vapor flows piped through the vapor return passage 220 may be tied together to feed the single AFS 500 in the dispenser housing.

As stated above, the monitor 140 may connect to the dispenser controller 120, directly to the current loop interface wiring 130 or directly to the liquid fuel dispensing meter 240 to access the liquid fuel flow volume readings. The monitor 140 may also be connected to each AFS 500 at the facility 10 so as to be supplied with vapor flow amount (i.e. vapor volume) information. The liquid fuel flow volume readings are individualized fuel volume amounts associated with each dispensing point 210. Employing AFS's 500 allows determination of the actual A/L ratio of the vapor recovery system of the dispenser 200 in operation. If an AFS 500 is used to determine vapor flow volumes recovered for more than one dispensing point 210, as is illustrated in FIG. 1, the vapor flow volume readings are aggregate amounts resulting from various groupings of dispensing point 210 vapor flows. Therefore require mathematical analysis to separate or identify the amounts attributable to the individual dispensing points 210. This analysis may be accomplished by the monitor 140 which may include processing means.

Once the vapor flow information is determined for each dispensing point 210, the A/L ratios for each dispensing point 210 may be determined and a pass/fail determination may be made for each dispensing point based on the magnitude of the ratio. It is known that the ratio may vary from 0 (bad) to around 1.0 (good), to a little greater than 1.0 (which, depending upon the facility 10 design, can be either good or bad), to much greater than 1 (typically bad). This ratio information may be provided to the facility operator via an audio signal and/or a visual signal through the monitor 140. The ratio information may also result in the automatic shut down of a dispensing point 210, or a recommendation for dispensing point shut down.

In order to determine the acceptability of the performance of vapor recovery in the facility 10, the ratio of vapor flow to dispensed liquid fuel (A/L ratio) is determined for the fuel dispensing points 210 included in the facility. This A/L ratio may be used to determine if the fuel dispensing point 210 in question is in fact recovering an equal volume of vapor for each unit volume of liquid fuel dispensed by the dispensing point 210. Without use of AFSs 500, only initial calibration values could be used to control the vapor pump 222. Using AFSs 500 to calculate an actual A/L ratio allows the vapor recovery system to adjust the settings for the vapor pump 222 in a closed loop, feedback manner if the actual A/L ratio is different than desired. The adjustment can be made to attempt to bring the actual A/L ratio in line with desired tolerances or limits.

In the embodiment of the invention shown in FIG. 1, each dispensing point 210 is served by an AFS 500 that is shared with at least one other dispensing point 210. The AFS 500 is communicatively coupled to the dispenser control system 270 or the monitor 140 via wiring bus 502 to communicate the amount of vapor recovered. Mathematical data processing (described below) may be used to determine an approximation of the vapor flow associated with each dispensing point 210. The amount of fuel dispensed by each dispensing point 210 is known from the liquid fuel dispensing meter 240 associated with each dispensing unit. Amount of fuel (i.e. fuel volume) information may be transmitted from each dispensing meter 240 to the dispenser controller 120 for use by the monitor 140. In an alternative embodiment of the invention, the dispensing meters 240 may be directly connected to the monitor 140 to provide the amount of fuel information used to determine the AIL ratio for each dispensing point 210. Each AFS 500 measures multiple (at least two or more) dispensing point return vapor flows. It should be noted that further mathematical processing may not be required if a dedicated AFSs 500 is used per dispensing point 210 that can be active at any one time. Various groupings of combinations of feed dispensing point air flow's per AFS are possible which fall between these two extremes described.

FIG. 1 also illustrates a ORVR blocking valve 228 that is also employed in the vapor recovery system for ORVR compatibility reasons. The ORVR blocking valve 228 blocks the vapor return path of the dispensing point 210 when an ORVR vehicle is being refueled. This prevents ingestion of air when fueling vehicles that are ORVR-equipped. Since an ORVR-equipped vehicle is recovery its own vapor emission, the vapor pump 222 suction will cause outside air to be ingested in its place. Ingestion of air can cause vapor growth and eventually lead to fugitive emissions due to pressurization of the fuel storage tank 300, as is well known. The ORVR blocking valve 228 is like that disclosed in U.S. Pat. No. 6,810,922, previously referenced and incorporated by reference herein in its entirety.

When an ORVR-equipped vehicle is being fueled, a negative pressure is created in the vapor return path 220. The ORVR blocking valve 228 is designed to block the vapor return path 220 in response to this negative pressure so that suction of the vapor pump 222 does not cause air to be ingested. When a non ORVR-equipped vehicle is being fueled, the valve 228 will not close, thereby allowing the vapor pump 222 suction to be applied to the vapor return path 220 to recovery vapors expelled. The valve 228 may include a sensor device (not shown) that is communicatively coupled to the dispenser control system 270 with status information via communication line 242. The status will either be closed or opened, thereby indicating either an ORVR-equipped vehicle or non ORVR-equipped vehicle, respectively. As discussed later, the vapor recovery system must distinguish between ORVR and non ORVR-equipped vehicles to adjust the vapor recovery system to the desired A/L ratio.

Adjustment of Vapor Recovery System

FIG. 2 illustrates a basic flowchart diagram of the general operation of the vapor recovery adjustment system employing the AFSs 500 to determine the A/L ratio and make adjustments to the vapor recovery if necessary. FIGS. 3A-3B are flowchart illustrations of a more specific operation that is exemplary of one embodiment of the present invention. Note that even though each dispensing point 210 may have its own calculated A/L ratio, dispensing points sharing a common vapor pump 222 must be adjusted grossly to attempt to correct all A/L ratios at the same time.

Turning to FIG. 2, the process starts (step 1000), and a control system collects A/L ratio data for a given fuel dispensing point 210 excluding ORVR fueling transactions to form a selected data set of A/L ratios (step 1002). Note that the term "control system" is used to represent either the dispenser control system 270, dispenser controller 120, monitor 140, remote system 134, or other control system.

The system can distinguish between ORVR and non-ORVR fueling events in different manners. If the ORVR blocking valve 228 contains a sensing device that is coupled to the control system 270, the system can distinguish between ORVR and non-ORVR-equipped vehicles on a transaction-by-transaction basis. Thus, the A/L ratio and adjustment, if necessary, can be calculated for non-ORVR-equipped vehicles on a per transaction basis or for an aggregate of non-ORVR fueling transactions. The system may also identify to exclude ORVR fueling transactions for the A/L ratio calculations using the techniques described in U.S. Pat. Nos. 5,728,275; 5,992,395; 6,026,868; 6,065,507; 6,460,579; 6,499,516; 6,810,922; 6,923,221; 6,941,978, all of which are incorporated by reference herein in their entireties.

The system may also distinguish between ORVR and non ORVR-equipped vehicles using a series of statistical algorithms to distinguish between ORVR and non-ORVR equipped vehicles using a set of collected A/L ratio data from all monitored dispensers at the fuel dispensing facility 10. Activity on one dispensing point 210 is compared to others at the fuel dispensing facility 10 using the technique described U.S. Pat. No. 6,622,757, incorporated herein by reference in its entirety. Thus in summary, the A/L ratio data may be for a single dispensing transaction, or data collected for a number of transactions over a given time period, including a day, days, and/or weeks. Further, the data collected may be for a rolling period.

After the A/L ratio selected data set is collected, whether it be for single or multiple transactions, the control system next calculates an A/L calibration adjustment value for a given fuel dispensing point 210 based on the A/L selected data set (step 1004). In the example of FIG. 1, this A/L calibration adjustment value is a control setting for the motor 224 to adjust the vapor pump 222 speed to alter the vapor recovery rate. Other systems may employ constant speed vapor pumps and use a variable orifice valve to control the recovery rate as is well known. In this system, the opening of the variable orifice valve is adjusted, rather that the speed of the vapor pump 222, to control the vapor recovery rate.

The adjustment value may be calculated in any number of methods. For example, the adjustment value may be calculated like that described in the system of FIGS. 3A-3B, discussed below. The adjustment value may be calculated on a calibration formula in memory that correlates adjustment of the vapor pump 222 speed or valve opening based on the error in the A/L ratio (actual minus desired). The formula may or may not be linear depending on the characteristics of the vapor recovery system employed. The adjustment value may be calculated using a look up table having adjustment values correlated to A/L ratios or A/L ratio adjustment values, and interpolating in between values as necessary.

Lastly, the vapor recovery rate is adjusted based on the calculated "A/L calibration adjustment value (step 1006). The process then repeats (step 1002) to continue to collect A/L ratio data and adjust the vapor recovery system accordingly to attempt to match the actual performance of the system to the desired performance, measured in terms of A/L ratios.

FIGS. 3A-3B illustrate a flowchart of an exemplary vapor recovery system adjustment embodiment employing a specific algorithm that is consistent with the description of the general system in FIG. 2. The process starts (step 2000), and A/L ratio data for the dispensing points 210 serviced by the vapor pump 222 is collected using the AFS 500 and fuel meter 240 measurements (step 2002). Multiple grades of fuel are typically serviced by one vapor pump 222 for a given side of a fuel dispenser unit 200. The A/L ratio data is comprised of a plurality of transactions that excludes ORVR fueling transactions using either the statistical blockage detection technology discussed later in this application or by other methods previously described. This A/L ratio data forms a selected data set.

Next, the A/L selected data set data is filtered to reduce error, since some A/L ratio data may include error for any number of reasons (step 2004). For example, thermal effects may cause the AFS 500 to measure the vapor recovered as less or more than actual. Vapor compression may occur if the temperature of the vehicle tank is lower than the temperature at the AFS 500. Conversely, a lower temperature in the vehicle tank will cause vapor expansion. In an exemplary embodiment, the selected data set excludes the lower 40% and upper 10% of A/L ratio data. It is more probable that erroneous A/L ratio data will occur at the lower end of the data set than the upper end.

Next, a calculation of the vapor recovery system adjustment for each grade of fuel is calculated according to the following formulas for a vapor recovery system employing a variable speed vapor pump 222, like that illustrated in FIG. 1. Each grade of fuel will have a different A/L ratio, even though each side of the dispenser 200 employs a common vapor pump 222 and AFS 500 for all grades in one embodiment. A discussion of each calculation follows with reference to the flowchart in FIG. 3B (steps 2006-2024), and in accordance to the example that follows:

EXAMPLE

| | |
|---|---|
| maxA-L = 1.2 | |
| minA-L = 1.0 | |
| saftyMargin = 5% | |
| **Grade A** | |
| nominalA-L = | 1.1 |
| totalLiquidDispensed = | 500 gal. |
| totalVaporCollected = | 400 gal. |
| collectionVariance = | (1.1 * 500 gal.) − 400 gal. = 150 gal. |
| gradeFlowRate = | 7.5 GPM |
| pumpingTime = | 53 min. |
| desiredVaporPumpAdjustment = | 150 gal./53 min. = 2.8 gal./min. |
| maxPosVaporPumpAdj = | 3.19 gal./min. |
| maxNegVaporPumpAdj = | 2.34 gal./min. |
| currentActualA-L = | 0.80 |
| correctedVaporCollection = | 405 gal. |
| correctedA-L = | 0.81 |
| **Grade B** | |
| nominalA-L = | 1.1 |
| totalLiquidDispensed = | 133 gal. |
| totalVaporCollected = | 150 gal. |
| collectionVariance = | (1.1 * 133 gal.) − 150 gal. = −3.0 gal. |
| gradeFlowRate = | 7.5 GPM |
| pumpingTime = | 20 min. |
| desiredVaporPumpAdjustment = | −3.0 gal./20 min. = −0.2 gal./min. |
| maxPosVaporPumpAdj = | 0.1 gal./min. |
| maxNegVaporPumpAdj = | −0.5 gal./min. |
| currentActualA-L = | 1.13 |
| correctedVaporCollection = | 152 gal. |
| correctedA-L = | 1.14 |
| **Grade C** | |
| nominalA-L = | 1.1 |
| totalLiquidDispensed = | 33.3 gal. |
| totalVaporCollected= | 36 gal. |
| collectionVariance = | (1.1 * 33.3 gal.) − 36 gal. = 0.7 gal. |
| gradeFlowRate = | 7.5 GPM |
| pumpingTime = | 5 min. |
| desiredVaporPumpAdjustment = | 0.3 gal./5 min. = 0.1 gal./min. |
| maxPosVaporPumpAdj = | 0.42 gal./min. |
| maxNegVaporPumpAdj = | −0.21 gal./min. |
| currentActualA-L = | 1.08 |
| correctedVaporCollection = | 36 gal. |
| correctedA-L = | 1.09 |
| Overall Adjustment Values | |
| avgDesiredVaporPumpAdjustment = | 0.93 gal./min. |
| correctedAvgDesiredVaporPumpAdjustment = | 0.10 gal./min. |
| finalAdjustment = | 0.1 gal./min. |

A description of some of the calculations listed above are provided below:

maxA-L=the maximum A/L ratio for the vapor recovery system to be within the desired operating range minA-L=the minimum A/L ratio for the vapor recovery system to be within the desired operating range saftyMargin=the safety margin or tolerance used to determine the maximum positive and negative adjustment that can be made to the vapor recovery system without the system going outside a permitted safety range.

gradeFlowRate=a measured value provided by the common dispenser controller electronics, flow rate monitoring technology or an assumed 7.5 gallons per minute (GPM)

pumpSpeed=current pump speed in GPM nominalA-L=middle of certified A/L range collectionVariance=nominalA-L*totalLiquidDispensed–totalVaporCollected pumpingTime=totalLiquidDispensed/gradeFlowRate desiredVaporPumpAdjustment=collection Variance/pumpingTime The calculations described for the examples above are discussed in detail below according to steps 2006-2024 in FIGS. 3A-3B. Since there is typically a different A/L ratio for each grade of fuel, the A/L ratio calculation and adjustment is determined for each grade individually. At the end of calculations, a gross adjustment is made to the vapor pump 222 so that all grades are corrected. The calculations for "Grade A" in the example above are discussed below in particular as an example, but the same calculations are made for all other grades.

The nominal A-L ratio (nominalA-L) is the middle of the desired or required range of the A/L ratio performance, which is between 1.0 and 1.2 according to the example above. In the example, the A/L ratio is 1.1, meaning that 10% more vapor is to be recovered than fuel dispensed. The A/L ratio 1.1 may be set higher than 1.0 if there are losses at the nozzle of the dispensing point 210 to vehicle fuel tank interface. Some losses do occur in a non-sealed vapor recovery assist type system.

The total liquid dispensed (totalLiquidDispensed) is the total amount of fuel grade dispensed over the period of time being analyzed. This measurement is performed by the fuel meters 240, as previously discussed for FIG. 1. In the "Grade A" example above, the total liquid dispensed is equal to 500 gallons.

The total vapor collected (totalVaporCollected) is the total amount of vapor that was recovered for the given grade of fuel over the period of time being analyzed. This measurement is performed by the AFS 500 as previously discussed. In "Grade A" in the example above, the total vapor collected is equal to 400 gallons. Notice that the vapor collected is 100 gallons less than the fuel dispensed, thereby indicating an underachieving performing vapor recovery system.

A variance in the actual vapor collected compared to the vapor that should be recovered to achieve the nominal A-L ratio (nominalA-L), called "collectionVariance," is now calculated according to step 2006 in FIG. 3A. The variance according to "Grade A" in the example above is 150 gallons, meaning that 150 gallons more vapor should have been recovered than was actually recovered by the vapor recovery system over the period of time being analyzed to achieve the desired, nominal A/L ratio (nominalA-L). This indicates a vapor recovery system that is under performing according to desired specifications and according to the current calibration values controlling the vapor pump 222. Thus, an adjustment will be calculated and may be made.

The flow rate of the grade of fuel being analyzed (gradeFlowRate) is listed as 7.5 gallons per minute (GPM). This setting can be determined in a number of methods. The rate can be fixed according to historical data, or can be calculated based on the flow rate of the dispensing points 210 providing the given grade of fuel being analyzed. The flow rate can be calculated as the total liquid dispensed divided by time (totalLiquidDispensed/pumpingTime). A more accurate technique is disclosed in U.S. Pat. No. 6,975,964, assigned to the same assignee as the present application, and incorporated herein by reference in its entirety. This technique uses the same variables as the flow rate divided by time method, but also includes techniques to reduce or eliminate the "dead time" during a dispensing transaction for a more pumping time (pumpingTime), and thus results in a more accurate flow rate calculation.

As shown in step 2008 in FIG. 3A, the desired vapor pump adjustment (desiredVaporPumpAdjustment) is next calculated to determine the amount of adjustment, if any, that is to be made to the vapor pump 222 in terms of flow rate (gal./min.), to change the vapor recovery rate to bring the A/L ratio back into the desired tolerance. The desired vapor pump adjustment (desiredVaporPumpAdjustment) is the vapor collection variance (collectionVariance) divided by the pumping time (pumpingTime). In "Grade A" in the example above, the vapor pump adjustment is 150 gallons/63 minutes, which is equal to 2.8 gal./min. The adjustment should be made as long as each grade being analyzed will remain within the certified A/L ratio band plus or minus an allowed tolerance after the adjustment is made. If not, the adjustment should be further adjusted as much as possible without shifting a grade from its certified A/L ratio range.

Next, a maximum positive vapor pump adjustment (maxPosVaporPumpAdj) and maximum negative vapor pump adjustment (maxNegVaporPumpAdj) are calculated (step 2010 in FIG. 3A). These values determine the maximum amount of vapor pump 222 adjustment in terms of flow rate (gal./min.) that can be made without the A/L ratio for a given grade of fuel going outside safety limits. A positive vapor pump 222 adjustment is made for an underachieving system (i.e. a positive collectionVariance value, meaning not enough vapor was collected for fuel dispensed). Likewise, a negative vapor pump 222 adjustment is made for an overachieving system (i.e. a negative collection Variance value, meaning too much vapor was collected for fuel dispensed).

The maximum positive vapor pump adjustment (maxPosVaporPumpAdj) is calculated as follows:

$$\frac{\max A\text{-}L \times totalLiquidDispensed \times (1 - saftyMargin) - totalVaporCollected}{pumpingTime}$$

The maxPosVaporPumpAdj determines what adjustment to the vapor pump 222 can be made such that the total VaporCollected does not exceed the totalLiquidDispensed within a safety range for a given maxA-L. For the "Grade A" example, the maxPosVaporPumpAdj is equal to 3.19 gal./min., meaning that a maximum vapor pump 222 adjustment to increase the recovery of vapor at a rate of 3.19 gal./min. can be made without putting the system outside the operating safety range. If the maxPosVaporPumpAdj is greater than zero, this means that the vapor pump 222 is not already beyond its maximum adjustment and can be adjusted further. If the maxPosVaporPumpAdj is less than or equal to zero, this means that the vapor pump 222 is already beyond the maximum adjustment and no further adjustment can be made to increase the recovery of vapor without exceeding safety limits.

Similarly, the maximum negative vapor pump adjustment (maxNegVaporPumpAdj) is the maximum adjustment that can be made to the vapor pump 222 negatively (i.e. reduce the vapor recovery rate) and the system be within operating safety range for a given minA-L. The maximum negative vapor pump adjustment (maxNegVaporPumpAdj) is calculated as follows:

$$\frac{\min A\text{-}L \times totalLiquidDispensed \times (\min A\text{-}L + \min A\text{-}L \times saftyMargin) - totalVaporCollected}{pumpingTime}$$

For the "Grade A" example, the maxNegVaporPumpAdj is equal to 2.34 gal./min. If the maxNegVaporPumpAdj is greater than zero, the vapor pump 222 is already beyond its maximum negative adjustment and cannot be adjusted further. Since the maxNegVaporPumpAdj is 2.34 gal./min., no negative adjustment to the vapor pump 222 is possible without the system exceeding the bounds of the prescribed safety range.

Next, the average of all the desired vapor pump adjustments for all grades of fuel is calculated (step 2012). An average adjustment is made to the vapor pump 222 as a result of the process, because the vapor pump 222 and the AFS 500 for each side of the fuel dispenser unit 210 services all grades. The average of the desired vapor pump 222 adjustment (avgDesiredVaporPumpAdjustment)=0.93 gal/min. for the examples listed above (2.8−0.2+0.1 gal/min./3 grades). This value is the average desired vapor pump 222 adjustment that in theory is made to bring the average A/L ratio for all grades of fuel back within the desired tolerance for a gross correction.

Note that the average adjustment is a positive value, meaning a vapor pump 222 adjustment should be made to increase the rate of vapor recovery and bring the gross A/L ratios to the desired value. However, if the average of the desired vapor pump adjustment (avgDesiredVaporPumpAdjustment) is greater than any one grade's maximum positive vapor pump adjustment (maxPosVaporPumpAdj), the average correction (avgDesiredVaporPumpAdjustment) cannot be made. Since "Grade B" can only be adjusted 0.10 gal./min. as its maximum positive vapor pump adjustment (maxPosVaporPumpAdj), a final calculated adjustment (finalAdjustment) can only be 0.10 gal./min. (step 2014). In other words, the final adjustment (finalAdjustment) can only be the minimum of the maximum positive vapor pump adjustments (maxPosVaporPumpAdj) for all grades. Otherwise, the adjustment will adjust the vapor pump 222 in a manner that will take Grades B and C outside safety tolerance ranges for the example provided above.

Likewise, if the average of the desired vapor pump adjustment (avgDesiredVaporPumpAdjustment) was a negative value, this would mean that the vapor pump 222 should be adjusted negative instead of positively. The final adjustment (finalAdjustment) would be the maximum of the maximum negative vapor pump adjustments (maxNegVaporPumpAdjustment) for the grades of fuel. In this manner, the negative adjustment to the vapor pump 222 would be made in a manner that no grade of fuel is adjusted outside its calculated safety tolerance range. In the example above, the average of the desired vapor pump adjustment (avgDesiredVaporPumpAdjustment) is greater than zero, so a positive vapor pump 222 adjustment is made.

At this point, it has been determined that the final adjustment (finalAdjustment)=0.1 gal./min. to the vapor pump 222 as the maximum adjustment that can be made to the vapor pump 222 to improve the A/L ratio of the grades of fuel while not also adjusting any one grade of fuel outside a safety tolerance range. The final adjustment (finalAdjustment) is next used to calculate the corrected vapor collection value (correctedVaporCollection), which is a calculation of the amount of vapors that will be collected for each grade of fuel as a result of the calculated final adjustment (finalAdjustment) for the vapor pump 222 (step 2016).

For "Grade A" in the example above, the corrected vapor collection value (correctedVaporCollection) is the final adjustment (finalAdjustment) of 0.1 gal./min. times the pumping time (pumpingTime) of 53 min., plus the total vapor collected (totalvaporCollected) of 400 gal. This value is equal to 405 gallons, meaning that the vapor pump 222 should be corrected so that 405 gallons of vapor should have been collected instead of 400 gallons. Because the corrected vapor collection value (correctedVaporCollection) is calculated based on the final adjustment (finalAdjustment), the corrected vapor collection (correctedVaporCollection) can be achieved for the selected grade of fuel and still keep all grades of fuel within safety tolerance range.

Lastly, the corrected A/L ratio (correctedA-L) is calculated by dividing the corrected vapor collection (correctedVaporCollection) of 405 gallons by the total liquid dispensed (totalLiquidDispensed) to equal 0.81 (step 2018). The system then adjusts the vapor pump 222 so that the corrected A/L ratio (correctedA-L) is achieved.

Note that all of the grade's corrected A/L ratios (correctedA-L) are within the tolerance of the minimum A/L ratio (minA-L) of 1.0 and the maximum A/L ratio (maxA-L) of 1.2, except Grade A. Since the best correction that can be performed on Grade A is 0.81 corrected A/L ratio (correctedA-L), without taking the other grades outside the tolerances of adjustment, an alarm and/or report can be generated and/or communicated to the control system (steps 2020, 2022). The alarm and/or report indicates that even with the maximum corrected made to the dispensing point 210. Grade A's A/L ratio is still outside of the allowable tolerance range. From there, the dispensing point 210 could be shut down, or the error reported to the remote system 134, so that corrective measures can be taken to investigate, and the process ends (step 2024) or repeats (step 2002).

As alternatives, the control system 270 that controls the vapor pump 222 can store different pump settings for each grade of fuel on a given dispenser 200 side. This allows avoidance of making compromised adjustments to keep all grades within their certified A/L range without one dispenser side affecting the other. Further, a time weighted average of previous adjustments could also be used to make that actual vapor pump adjustment, since A/L ratios tend to drift slowly over time, abrupt large changes are indicative of a problem and adjustments should not be attempted under this situations.

Alternative Vapor Recovery System Embodiments

FIGS. 4 and 5 illustrate alternative embodiments of the present invention. In FIG. 4, the vapor recovery system uses the variable speed vapor pump 222 and motor 224 combination to recovery vapor like that illustrated in FIG. 1. However in FIG. 4, each dispensing point 210 has its own dedicated AFS 500 and vapor pump 222. In this manner, a plurality of A/L ratio data from a multitude of transactions does not have to be gathered in order to make an adjustment since the A/L ratio for each dispensing point 210 is known for every transaction. If an AFS 500 is shared among multiple dispensing points 210, multiple transactions are required in order to perform the statistical analysis necessary to estimate the A/L ratios for individual dispensing points 210. This technique is discussed U.S. Pat. No. 6,622,757, previously referenced above and incorporated herein by reference in its entirety.

FIG. 5 illustrates a different type of vapor recovery system employing a constant speed vapor pump and valves having variably controlled orifices 243 to control the recover of vapor. This system was previously described above. In the embodiment, a single AFS 500 measures all the dispensing point vapor flows for the facility 10. In the case of a single AFS 500 per facility 10, the AFS 500 is installed in the single common vapor return pipeline 410 which runs between all the dispensers as a group, which are all tied together into a common dispenser manifold pipe, and all the main fuel storage tanks 300 as a group, which are all tied together in a common tank manifold pipe.

The vapor adjustment is made by changing the opening of the orifice in the valve 243 rather than variably controlling the speed of the vapor pump 222. However, all of the concepts described above regarding determination of A/L ratios for non-ORVR transactions, and calculating a vapor adjustment are equally applicable. Note that although the vapor pump 222 adjustment example previously discussed above is described with respect to a variable speed vapor pump 222 to control vapor recovery rate, the present invention may also be used to determine the adjustment of a proportional valve system employing a constant speed motor(s) to control the vapor recovery rate in a similar manner.

Those skilled in the art will recognize improvements and modifications to the preferred embodiments of the present invention. All such improvements and modifications are considered within the scope of the concepts disclosed herein and the claims that follow.

What is claimed is:

1. A method for adjusting a vapor recovery system in a fuel dispenser having one or more dispensing points adapted to fuel ORVR and non ORVR-equipped vehicles, comprising the steps of:

collecting A/L ratio data for a plurality of fueling transactions at the fuel dispenser using measurements from at least one air flow sensor coupled to the fuel dispenser vapor recovery system and from at least one fuel meter that indicates an amount of fuel dispensed by the one or more dispensing points;

excluding ORVR fueling transactions from the collected A/L ratio data to form a non-ORVR A/L ratio data set;

calculating a desired A/L calibration adjustment value for the fuel dispenser vapor recovery system based on the non-ORVR A/L ratio data set and a permitted A/L ratio range; and adjusting the fuel dispenser vapor recovery system based on the A/L calibration adjustment value.

2. The method of claim 1, wherein the step of collecting comprises collecting A/L ratio data for all of the dispensing points for the fueling transactions at the fuel dispenser.

3. The method of claim 1, further comprising excluding upper and lower end data from the non-ORVR A/L ratio data set to eliminate and/or reduce thermal effects of the fueling transactions from the non-ORVR A/L ratio data set.

4. The method of claim 1, wherein the step of calculating an A/L calibration adjustment comprises:

calculating a vapor collection variance by calculating the difference between a total amount of fuel dispensed by the fuel dispenser and a total amount of vapor recovered by the vapor recovery system; and calculating a desired A/L calibration adjustment based on the vapor collection variance.

5. The method of claim 4, wherein calculating the vapor collection variances comprises multiplying a nominal A/L ratio times the total amount of fuel dispensed minus the total amount of vapor recovered.

6. The method of claim 5, wherein calculating the desired A/L calibration adjustment comprises dividing the vapor collection variance by the pumping time of the fueling transactions.

7. The method of claim 6, further comprising calculating a maximum positive A/L calibration adjustment for the vapor recovery system such that an adjustment to the vapor recovery system to increase the total amount of vapor recovered does not exceed the total amount of fuel dispensed within a safety range for a maximum permitted A/L ratio for the fuel dispenser within the permitted A/L ratio range.

8. The method of claim 6, further comprising calculating a maximum negative A/L calibration adjustment for the vapor recovery system such that an adjustment to the vapor recovery system to decrease the total amount of vapor recovered does not exceed the total amount of fuel dispensed within a safety range for a minimum permitted A/L ratio for the fuel dispenser within the desired A/L ratio range.

9. The method of claim 2, further comprising calculating an average desired A/L calibration adjustment value for all of the dispensing points to bring the A/L ratio for all of the dispensing points within the permitted A/L ratio range.

10. The method of claim 9, further comprising calculating a maximum positive A/L calibration adjustment for each of the dispensing points in the vapor recovery system such that an adjustment to the vapor recovery system to increase the total amount of vapor recovered for each dispensing point does not exceed the total amount of fuel dispensed within a safety range for a maximum permitted A/L ratio for the fuel dispenser within the permitted A/L ratio range.

11. The method of claim 10, further comprising calculating a maximum negative A/L calibration adjustment for each of the dispensing points in the vapor recovery system such that an adjustment to the vapor recovery system to decrease the total amount of vapor recovered for each dispensing point does not exceed the total amount of fuel dispensed within a safety range for a minimum permitted A/L ratio for the fuel dispenser within the permitted A/L ratio range.

12. The method of claim 11, wherein adjusting the fuel dispenser vapor recovery system comprises:

determining a final A/L calibration adjustment for all the dispensing points based on the maximum positive A/L calibration adjustment and the minimum A/L calibration adjustment for each dispensing point, and adjusting each of the dispensing points in the fuel dispenser vapor recovery system based on the final A/L calibration adjustment.

13. The method of claim 12, further comprising calculating a corrected vapor collection for each of the dispensing points based on the final A/L calibration adjustment.

14. The method of claim 13, further comprising calculating a corrected A/L ratio for each of the dispensing points after the final A/L calibration adjustment is made to the fuel dispenser vapor recovery system.

15. The method of claim 14, further comprising determining if any of the dispensing points' corrected A/L ratios are outside the permitted A/L ratio range.

16. The method of claim 15, further comprising generating an alarm and/or report if any of the dispensing points' corrected A/L ratios are outside the permitted A/L ratio range.

* * * * *